US007052212B1

(12) United States Patent
Joyner

(10) Patent No.: US 7,052,212 B1
(45) Date of Patent: May 30, 2006

(54) DOWNSPOUT ENERGY DISSIPATER SPLASH PAD WITH SPILLWAY

(76) Inventor: Bobby Joyner, P.O. Box 7966, Rocky Mount, NC (US) 27804-7966

( * ) Notice: Subject to any disclaimer, the term of this patent is extended or adjusted under 35 U.S.C. 154(b) by 0 days.

(21) Appl. No.: 11/125,664

(22) Filed: May 10, 2005

(51) Int. Cl.
*E04D 13/08* (2006.01)

(52) U.S. Cl. ..... 406/36; 405/302.6; 405/119; 52/16

(58) Field of Classification Search ..... 405/36, 405/119, 302.6; 52/11–16
See application file for complete search history.

(56) References Cited

U.S. PATENT DOCUMENTS 4,620,817 A * 11/1986 Cushing ..... 52/16
5,735,304 A * 4/1998 Chumley ..... 52/16
6,202,358 B1 * 3/2001 Janesky ..... 52/16
6,805,517 B1 * 10/2004 Chapek ..... 405/36

* cited by examiner

*Primary Examiner*—Frederick L. Lagman
(74) *Attorney, Agent, or Firm*—Coats & Bennett, P.L.L.C.

(57) ABSTRACT

A splash pad is provided for receiving water directed from a roof structure down a downspout. The splash pad includes a bottom and a surrounding wall structure. A spillway is provided that permits accumulated water in the splash pad to spillover and be discharged from the splash pad. An aggregate such as riprap can be contained within the splash pad for dissipating the kinetic energy of water discharge by the downspout. In addition, a lip can be provided outwardly of the spillway for dissipating the kinetic energy of the water spilling from the splash pad.

23 Claims, 3 Drawing Sheets

DOWNSPOUT ENERGY DISSIPATER SPLASH PAD WITH SPILLWAY

FIELD OF THE INVENTION

The present invention relates to splash pads for dissipating kinetic energy of water being discharged from a downspout.

BACKGROUND OF THE INVENTION

Downspout splash pads have been used for years on residential, commercial and industrial buildings in an effort to kill the impact and energy of water exiting from a vertical outlet such as downspout. Usually made of pre-cast concrete or other composite material, conventional splash pads commonly come in two sizes, one for residential uses and the other, typically slightly larger, for commercial and industrial buildings. One of the principal drawbacks to conventional splash pads is that their designs do not take into account the volume of water that will impact and pass over them. Conventional splash pads may kill the impact energy immediately below the downspout opening, but they do nothing to stop the erosion of soil just downhill of the splash pads caused by large volumes of water discharged by the downspout.

Soil erosion is a serious problem especially in the case of buildings with large roof expanses. Indeed, the problem is so pronounced that in order to curtail erosion in and around buildings with large roof expanses, designers of industrial buildings have opted for underground drainage systems to intercept the runoff and convey the runoff to other pipes that eventually discharge to a ditch outfall. This approach to solving the soil erosion problem is very expensive.

Therefore, there is and continues to be a need for a splash pad that not only dissipates the energy of the falling water, but also acts to control soil erosion downstream or downhill from the splash pad.

SUMMARY OF THE INVENTION

The present invention comprises a splash pad for receiving water from a downspout associated with a building and controlling the velocity and discharge flow rate of water from the splash pad. The splash pad includes a surrounding sidewall structure that defines a water receiving area. An aggregate such as riprap can be disposed within the splash pad for dissipating kinetic energy of water directed from the downspout into the splash pad. Formed about the splash pad is a spillway that permits water accumulated in the splash pad to be discharged.

Further, the present invention entails a method of controlling erosion resulting from water from a roof structure being discharged through a downspout. The method entails directing water from the roof structure to a downspout and from the downspout onto an aggregate, such as riprap, contained within a splash pad having a surrounding wall structure and a bottom formed by a structure or even the ground. Water received by the splash pad is confined therein by the surrounding wall structure. Accumulated water is directed from the splash pad through a spillway formed on the splash pad.

Other objects and advantages of the present invention will become apparent and obvious from a study of the following description and the accompanying drawings, which are merely illustrative of such invention.

DESCRIPTION OF EXEMPLARY EMBODIMENTS

Figure 1:
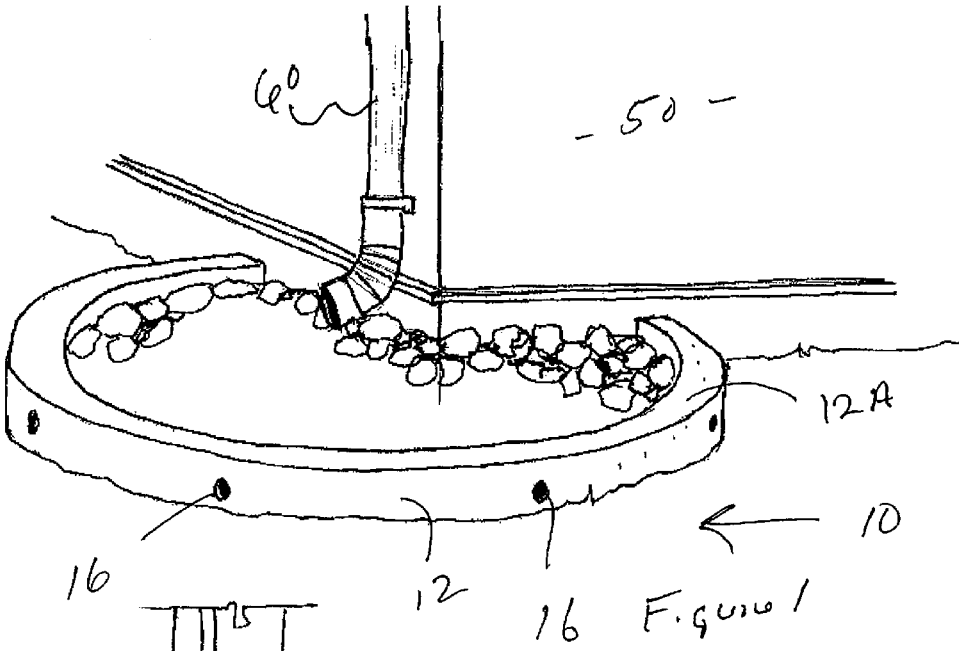
FIG. 1 is a perspective view of the splash pad of the present invention.

With further reference to the drawings, the splash pad of the present invention are shown therein and indicated generally by the numeral 10. As will be appreciated from subsequent portions of this disclosure, splash pad 10 is designed to be located or positioned adjacent a building 50 having a downspout 60 extending downwardly along a corner or side portion of the building 50. Downspout 60 is aligned with a splash pad 10 such that water discharged by the downspout will be directed into the splash pad 10.

Splash pad 10 includes a surrounding sidewall structure 12. Extending between the sidewall structure 12 is a bottom 14. Bottom 14 may be structured such as in the case where the splash pad 10 is constructed of plastic or metal. Alternatively, the bottom 14 can simply be a mud slab. Bottom 14 may be particularly sloped. That is, the central portion of the bottom 14 may be slightly raised such that the bottom as a whole slopes downwardly towards the surrounding sidewall structure 12. A series of weep holes 16 can be provided in the sidewall structure 12. Weep holes 16 would be placed at an elevation such that residual water contained within the splash pad 10 could drain therefrom. It is contemplated that the splash pad 10 would be made watertight uphill from the splash pad 10. That means, of course, the splash pad 10 would be particularly designed and/or oriented such that the weep holes 16, when the splash pad is installed, would be directed downhill.

Further, the splash pad 10 would include an aggregate such as riprap. The aggregate would be disposed on the bottom and would extend upwardly within the splash pad 10 a selected distance. By placing the aggregate or rip rap in the splash pad, the energy associated with the water exiting the downspout 60 is dissipated.

A spillway 12A is formed around an exterior portion of the splash pad 10. In the case of the design shown in FIGS. 1–3, the spillway 12A is formed along an upper edge of the surrounding sidewall structure 12. As water accumulates in the splash pad 10, it will rise to the level of the spillway 12A and then spill over and exit from the splash pad. It is appreciated that a section of the surrounding sidewall structure can be indented such that only a segment of the surrounding sidewall structure will form the spillway 12A. This permits selective diversion of the water from the splash pad.

Disposed just outside of the spillway 12A is a lip 18. See FIGS. 2 and 3. Lip 18 will dissipate the kinetic energy associated with the water falling from the spillway. Thus, as seen in the drawings, as the water exits the splash pad 10, the water will move over the spillway 12A and fall onto and impact against the lower disposed lip 18.

Figure 2:
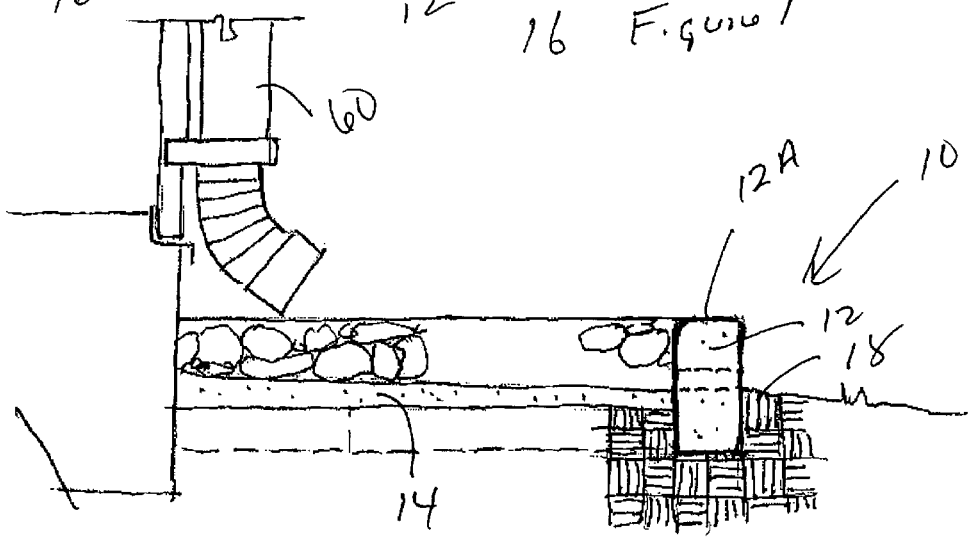
FIG. 2 is a cross sectional view of the splash pad shown in FIG. 1.
Figure 3:
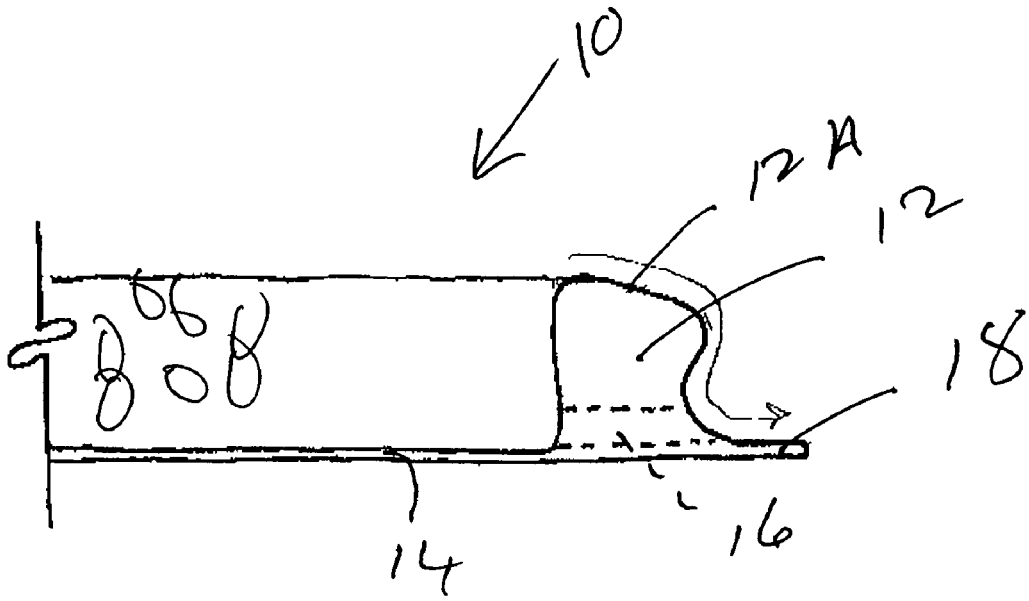
FIG. 3 is a cross sectional view of an alternative splash pad.

Splash pad 10 of the design shown in FIGS. 1–3, can be constructed of various materials including concrete, plastic or metal. Further, splash pad 10 can assume various shapes. For example, splash pad 10 may be in the form of a quarter-round, half-round, three-quarter, or even a full circle. Additionally, splash pad 10 can be square, rectangular or even other odd or irregular shapes.

Figures 4, 5, 6:
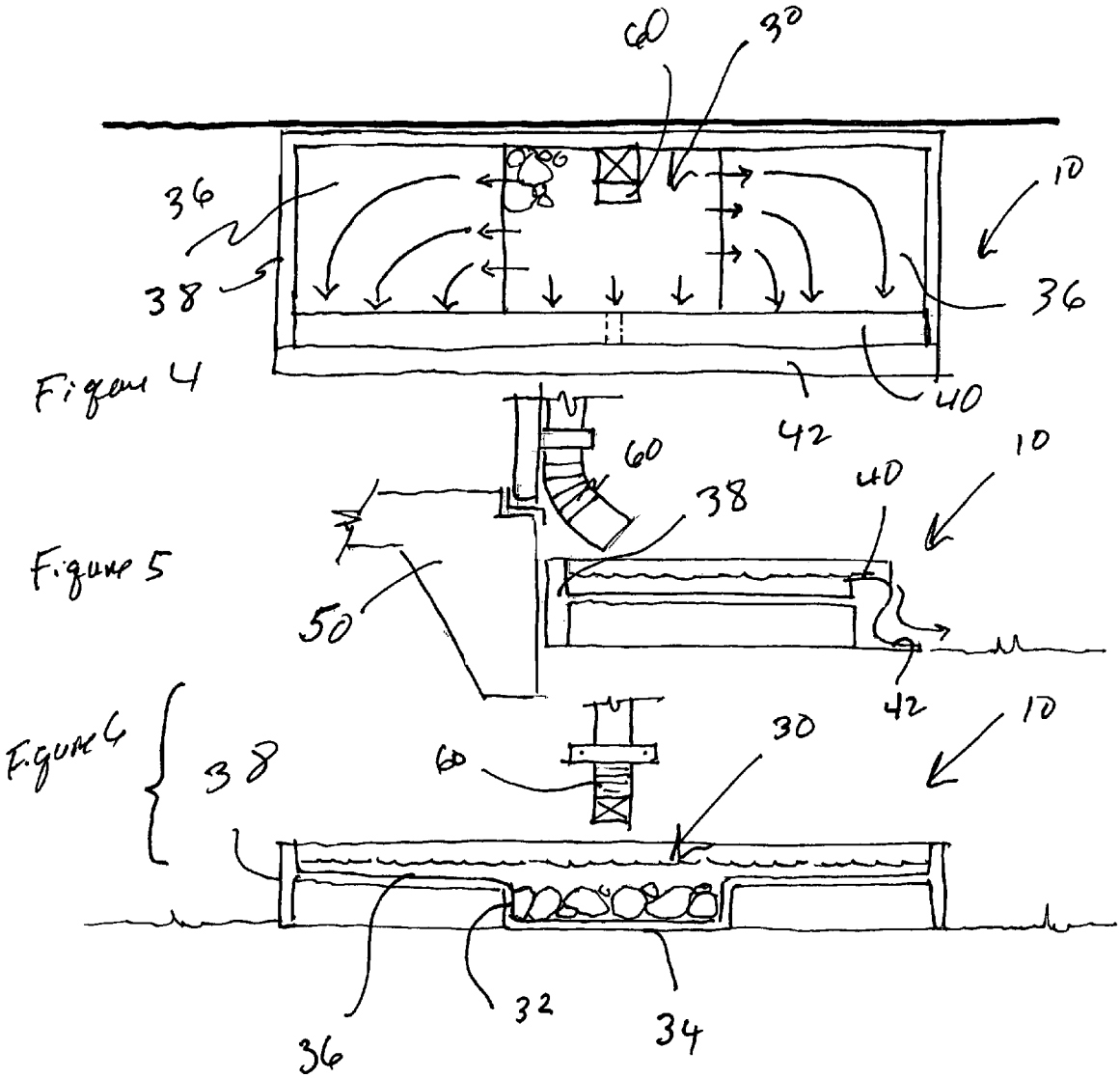
FIG. 4 is a top elevational view of yet another alternative splash pad.
FIG. 5 is a side elevational view of the splash pad shown in FIG. 4.
FIG. 6 is a cross sectional view of the splash pad shown in FIG. 4.

Shown in FIGS. 4–6 is another embodiment of the splash pad 10 of the present invention. This splash pad design includes an inner cell indicated generally by the numeral 30. Inner cell 30 is a depression formed in the splash pad and formed by a bottom 34 and surrounding wall structure 32. Inner cell 30 is designed to receive and hold aggregate such as riprap. As with the embodiment illustrated in FIGS. 1–3, this embodiment may also be provided with weep holes formed in the wall structure 32 adjacent the bottom 34. Thus, residual water remaining in the inner cell 30 can be drained therefrom via the weep holes, preventing mosquito breeding.

Formed on the splash pad 10 adjacent the inner cell 30 is a pair of pad areas or surface areas 36. In this particular design there is provided a pad area 36 on each side of the inner cell. Pad area 36 is elevated with respect to the bottom 34 of the inner cell 30.

Surrounding at least a portion of the splash pad 10 is a sidewall or retaining wall 38. In the case of the particular design shown in FIGS. 4–6, the retaining wall 38 includes a back and a pair of sides. Formed between the opposed sides that make up the retaining wall 38 is a spillway 40. Spillway 40 is disposed at an elevation below the upper edge of the retaining wall 38 and, in one embodiment, about at an elevation generally equal to the elevation of the pad area 36. Water that moves over the pad areas 36 will be dispersed from the splash pad 10 by the spillway 40. Disposed below the spillway 40 is a lip 42. Lip 42 dissipates the kinetic energy of water passing from the inner cell 30 and pad areas 36 over the spillway 40. It is appreciated that as water is directed from a downspout 60 into the inner cell 30 that water will accumulate therein and once the inner cell is filled, it follows that water therefrom will spill over or move onto the pad areas 36. From the pad areas 36, the water, because of the retaining wall 38, will be forced to move over the spillway 40, falling onto the lip 42.

In the case of the embodiment or design shown in FIGS. 4–6, the splash pad 10 is situated underneath a downspout 60 such that the downspout is aligned with the inner cell 30. Hence, water being discharged from downspout 60 is directed into the inner cell 30. The aggregate or riprap contained within the inner cell will break or dissipate the kinetic energy associated with the falling water. In the case of the splash pad 10 shown in FIGS. 4–6, the spillway is situated or aligned in the downhill direction. Hence, water discharged from the splash pad 10 will be directed in the downhill or downgrade direction. It is appreciated that the retaining wall 38 and the spillway 40 can be designed for particular applications to take into account the basic topography or configuration of the ground in and around a building where a downspout exists.

The splash pad 10, for either design discussed herein, can be constructed in various sizes. For example, the splash pad 10 can be manufactured in standard sizes to cover modular roof areas. For example, a 6' radius or 3' by 12' wide splash pad will accommodate runoff in coastal North Carolina areas with a tributary roof area of 20'×200' releasing across the top of the splash pad spillway approximately ⅓ gallon of water per second per foot of spillway length.

As noted above, the splash pads 10 can be constructed of various materials including concrete, metal, plastic, fiberglass or other similar non-biodegradable, resilient materials. Splash pads 10 can be installed on level ground. Typically an area underneath a downspout is dug out and the splash pad 10 is installed and leveled. Thereafter, the splash pad is backfilled, either partially or wholly with stone, with average sizes of 3" to 6" in diameter.

As discussed above, the aggregate used in the splash pads may be riprap or other insoluble materials. Also, the aggregate may include high-carbon ash, which could possibly remove nitrogen and phosphorous as well as other contaminants from water discharged into the splash pads.

The principal advantage of the splash pad 10 of the present invention is that it curtails or at least minimizes erosion from water being discharged from downspouts associated with buildings with relatively large roof structures. The splash pad 10 of the present invention is designed to remove or dissipate the kinetic energy associated with the falling water and hence distribute the water from the splash pad in a gentle fashion such that the water does not erode soil as it moves from the building to lower elevations.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A splash pad for controlling the discharge of water from a roof structure and erosion that results from the discharge from a roof structure, the splash pad comprising:

a. a surrounding wall structure extending around at least a portion of the splash pad;

b. a spillway forming a part of the splash pad for permitting water to spill over from the splash pad;

c. an interior cell formed in the splash pad for receiving falling water from the roof structure, the inner cell disposed interiorly of the surrounding wall structure and the spillway and including a depression formed in the splash pad for holding media that is effective to dissipate energy associated with the water falling into the inner cell;

d. the inner cell including a bottom and a surrounding sidewall structure;

e. a pad disposed adjacent the inner cell for receiving water from the inner cell and directing the water to the spillway;

f. the pad area having an upper surface that is elevated with respect to the bottom of the inner cell; and g. a lip disposed below the spillway for dissipating kinetic energy of the water as the water moves over the spillway.

2. The splash pad of claim 1 wherein the surrounding wall structure includes an upper edge and wherein the spillway is disposed at an elevation below at least a portion of the upper edge of the surrounding wall structure.

3. The splash pad of claim 2 wherein the spillway discharges water from the splash pad in a selected direction while the surrounding wall structure retains the water in the splash pad until the water can be discharged over the spillway.

4. The splash pad of claim 1 including aggregate disposed in the inner cell.

5. A building structure comprising:

a. a sidewall;

b. a roof;

c. a downspout extending adjacent the sidewall for directing water from the roof; and d. the splash pad of claim 1 wherein the inner cell is aligned with the downspout for receiving water discharged by the downspout.

6. The splash pad of claim 1 wherein the splash pad is rectangular or square.

7. The splash pad of claim 6 wherein the rectangular or square shaped splash pad includes four sides wherein at least one side includes the spillway and wherein the surrounding wall structure confines water within the splash pad about at least two sides.

8. The splash pad of claim 1 wherein at least a portion of the splash pad includes an arcuate shape.

9. The splash pad of claim 1 further including a bottom and a series of weep holes formed in the sidewall structure.

10. A splash pad for receiving water from a building and controlling the discharge of the water to an area adjacent the buildings so as to control erosion due to the discharge of the water, the splash pad comprising:

a. an inner cell for holding media that dissipates energy associated with water directed into the inner cell from the building;

b. the inner cell including a bottom and a sidewall structure;

c. a retaining wall extending at least partially around an area of the splash pad and disposed at least partially outwardly from the inner cell;

d. a spillway formed on the splash pad for permitting water to spill over from the splash pad to an area adjacent the splash pad;

e. a pad area lying adjacent the inner cell for receiving water from the inner cell, the pad area being elevated relative to the bottom of the inner cell; and f. wherein water accumulates in the inner cell and moves to the adjacent pad area where the retaining wall acts to at least partially confine the water on the pad area, and wherein the height of the spillway with respect to the retaining wall is such that water disposed over the pad area is permitted to spill over the spillway and be discharged to an area adjacent the splash pad.

11. The splash pad of claim 10 further including a lip disposed adjacent the spillway for dissipating the kinetic energy associated with the water passing over the spillway.

12. The splash pad of claim 10 wherein the splash pad assumes a square or rectangular configuration, and wherein the retaining wall extends around three sides of the splash pad and the spillway extends at least partially along one side of the splash pad.

13. The splash pad of claim 10 including a series of weep holes for permitting water to weep from the pad area.

14. A building structure comprising:

a. a sidewall;

b. a roof;

c. a downspout extending adjacent the sidewall for directing water from the roof; and d. the splash pad of claim 10 wherein the inner cell is aligned with the downspout for receiving water discharged by the downspout.

15. A splash pad for receiving water from a downspout associated with a building and for controlling the flow of water from the splash pad comprising:

a. a bottom;

b. a surrounding wall structure extending around the bottom;

c. aggregate disposed in the splash pad for dissipating the kinetic energy of water directed from the downspout into the splash pad;

d. the upper portion of the retaining wall forming a spillway such that as water accumulates internally within the splash pad, the water spills over the spillway and out of the splash pad; and e. a series of weep holes formed in the surrounding wall structure adjacent the bottom, wherein the bottom is sloped towards the surrounding wall structure such that water tends to gravitate along the bottom towards the surrounding wall structure and weep holes.

16. A building structure comprising:

a. a sidewall;

b. a roof;

c. a downspout extending adjacent the sidewall for directing water from the roof; and d. the splash pad of claim 15 disposed underneath the downspout such that water discharged from the downspout is directed into the splash pad and into engagement with the aggregate disposed therein.

17. The splash pad of claim 15 wherein the surrounding wall structure assumes a generally arcuate or curved configuration.

18. The splash pad of claim 15 wherein the aggregate includes a carbon ash material.

19. A method of controlling the discharge of water from the roof structure of a building comprising:

a. directing water from the roof structure to a downspout;

b. directing the water from the downspout onto aggregate contained within a splash pad having a bottom and a surrounding wall structure;

c. containing the water within the splash pad;

d. directing at least a portion of the water over a spillway formed on the splash pad and from the splash pad; and e. directing at least a portion of the water through a series of weep holes formed in the surrounding wall structure wherein the bottom is sloped towards the surrounding wall structure such that at least a portion of the water tends to gravitate along the bottom towards the surrounding wall structure and weep holes.

20. The method of claim 19 wherein the surrounding wall structure includes a series of openings and wherein water is directed from the splash pad out the series of openings formed in the sidewall structure.

21. The method of claim 19 including directing the water from the downspout into an inner cell that includes the aggregate and filling the inner cell and causing the inner cell to overflow where the overflow is directed onto an adjacent area formed in the splash pad.

22. The method of claim 21 including directing the water from the area adjacent the inner cell to a spillway where the water is discharged over the spillway and from the splash pad while the water disposed over the area is confined about a selected area by a retaining wall.

23. The method of claim 19 wherein the aggregate includes a carbon ash material and the method includes directing the water over the carbon ash material.

* * * * *